US007040308B2

(12) United States Patent
Ciesiun

(10) Patent No.: US 7,040,308 B2
(45) Date of Patent: May 9, 2006

(54) DEVICE AND METHOD FOR ILLUMINATING LUMINESCENT PAINTBALLS

(76) Inventor: Paul M. Ciesiun, 15530, Manhattan, IL (US) 60442

( * ) Notice: Subject to any disclaimer, the term of this patent is extended or adjusted under 35 U.S.C. 154(b) by 85 days.

(21) Appl. No.: 10/461,911

(22) Filed: Jun. 13, 2003

(65) Prior Publication Data

US 2004/0031474 A1 Feb. 19, 2004

Related U.S. Application Data

(60) Provisional application No. 60/388,534, filed on Jun. 13, 2002.

(51) Int. Cl.
*F41B 11/00* (2006.01)

(52) U.S. Cl. ..... 124/47; 124/1

(58) Field of Classification Search ..... 124/45, 124/48, 49, 50, 51.1, 52, 1, 80, 47; 43/112, 43/113

See application file for complete search history.

(56) References Cited

U.S. PATENT DOCUMENTS

| | | | | | |
|---|---|---|---|---|---|
| 1,389,132 | A * | 8/1921 | Galavan | 362/101 |
| 1,693,368 | A * | 11/1928 | Cherry | 43/113 |
| 2,113,409 | A * | 4/1938 | Niemeyer | 43/113 |
| 2,568,279 | A * | 9/1951 | Walkup et al. | 250/459.1 |
| 3,059,373 | A * | 10/1962 | Gardner | 43/113 |
| 3,513,585 | A * | 5/1970 | Ross | 43/113 |
| 3,950,886 | A * | 4/1976 | Newhall et al. | 43/112 |
| 4,850,403 | A * | 7/1989 | Wiese | 141/95 |
| 4,856,226 | A * | 8/1989 | Taylor | 43/113 |
| 5,259,153 | A * | 11/1993 | Olive et al. | 43/113 |
| 5,301,456 | A * | 4/1994 | Jobin et al. | 43/113 |
| 5,311,413 | A * | 5/1994 | Farmer et al. | 362/154 |
| 5,415,151 | A * | 5/1995 | Fusi et al. | 124/56 |
| 5,666,417 | A * | 9/1997 | Liang et al. | 283/92 |
| 5,857,451 | A * | 1/1999 | Ciluffo et al. | 124/6 |
| 5,974,100 | A * | 10/1999 | Carsello et al. | 375/346 |
| 6,048,280 | A * | 4/2000 | Palmer et al. | 473/416 |
| 6,134,826 | A * | 10/2000 | Mah | 43/112 |
| 6,156,985 | A * | 12/2000 | Chiang | 200/344 |
| 6,298,841 | B1 * | 10/2001 | Cheng et al. | 124/56 |
| 6,481,432 | B1 * | 11/2002 | Rushton et al. | 124/49 |
| 6,530,173 | B1 * | 3/2003 | Meade et al. | 43/112 |
| 6,591,824 | B1 * | 7/2003 | Hatcher | 124/56 |
| 2002/0066874 | A1 * | 6/2002 | Drescher | 250/504 R |
| 2003/0000511 | A1 * | 1/2003 | Moritz | 124/73 |
| 2003/0213481 | A1 * | 11/2003 | Bell | 124/56 |

OTHER PUBLICATIONS

Pan Am Las Vegas 2002, WARPIG- World and Regional Paintball Information Guide-Tournanment□□http://www.warpig.com/paintball/tournament/panam/2...(Dec. 17, 2002).*

Ricochet UV Sneak Preview, Bill Mills, http://www.warpig.com/paintball/technical/loaders/ricochet_uv/index.shtml (Jun. 2002).*

* cited by examiner

*Primary Examiner*—Troy Chambers
(74) *Attorney, Agent, or Firm*—Cherskov & Flaynik

(57) ABSTRACT

A hopper device 50 for illuminating luminescent paintballs before the paintballs are projected down the barrel of a paintball gun includes a hopper shell 52, top and bottom rows 54 and 56 of ultraviolet lights 14 disposed at preselected portions of the shell 52 to maximize the exposure of the paintballs 11 to ultraviolet light emitted from the lights 14, a pair of low voltage D.C. batteries 58 that supply power via a switch 60 to an inverter 62 which increases the voltage to a magnitude used by the lights 14.

20 Claims, 18 Drawing Sheets

DEVICE AND METHOD FOR ILLUMINATING LUMINESCENT PAINTBALLS

This application is based on U.S. Provisional Application No. 60/388,534 filed on Jun. 13, 2002.

BACKGROUND OF THE INVENTION

1. Field of the Invention

The present invention relates to a game and/or sport of paintball conducted in low light or dark conditions ("night paintball") and more particularly, to a device that illuminates a luminescent paintball before being projected from a paintball "gun" thereby allowing a contest without illuminating the field of play that the players are competing upon.

2. Background of the Prior Art

Paintball is a fast growing game played mainly outdoors during daylight hours upon large areas of natural terrain or indoors upon artificial terrain. The object of the game is to strike an opposing player (commonly identified via an armband with corresponding markings) with a paintball projected from a specially designed "gun." The paintball includes a soft outer shell that collapses upon striking a targeted player thereby releasing an internal fluid or paint that adheres to and identifies the player as being "hit" which relegates him to observer status in a neutral zone for the remainder of the game.

To identify a player as being hit during a low light or night paintball game, the paint must be luminescent or capable of "glowing in the dark" for a predetermined period of time after the paintball strikes the targeted player thereby marking him or her. Further, the "glow" must cease in a relatively short period of time to prevent "hits" from being counted by a referee during a subsequent paintball game. The glowing paintball provides a visual display similar to tracer bullets shot from a gun during a firefight thereby enhancing the entertainment, visual, safety, accuracy and fair play aspects of night paintball.

Prior methods of charging luminescent paintballs have used a relatively large ultraviolet light (black light) in close proximity to a plurality of paintballs prior to being placed into a hopper or container to be ultimately used with a paintball gun on a field of play. The problem with this method is that relatively long periods of time are required to adequately "charge" the light "absorbing" particles throughout the luminescent paintballs to thereby cause the paintballs to glow sufficiently. Another problem with the method is that the light intensity of the charged paintballs start attenuating immediately upon being removed from the black light, resulting in the paintball being barely visible in flight when loaded and "shot" from a projecting mechanism (paintball gun). Yet another problem with this method is a relatively long time delay between the paintball's exposure to the ultraviolet light and the projection of the paintball from the gun. This time delay causes the glow to dissipate such that the luminescent paint is not visible when splattered upon an opposing player.

Another prior method of charging luminescent paintballs is described in U.S. Pat. No. 6,082,349 wherein a high voltage element is utilized to power a flash tube which is triggered to activate a phosphorescent ball as the ball is discharged through a tube in the paintball gun. The problem with this device is that expensive, complex and relatively fragile electronic and potentially dangerous power circuits are used to control and power a multitude of components that illuminate the phosphorescent balls.

A need exists for a mechanically rugged charging device and/or method that inexpensively and safely charges a phosphorescent paintball while the ball is stored in a portion of a paintball gun disassociated with the gun's discharge mechanism. Also, the device and/or method may include components that de-energize ultraviolet lighting that may be exposed to the human eye when a participant places paintballs in a hopper portion of a paintball gun. Further, the device and/or method must sufficiently charge the paintball such that upon being "shot" from the gun, the paintball will provide a luminous trail until engaging a target, whereupon the luminescent paint will continue to emit a luminous pattern for a predetermined time after being disposed upon the target surface.

SUMMARY OF THE INVENTION

It is an object of the present invention to overcome many of the disadvantages associated with illuminating phosphorescent fluids or paint in paintballs used for night paintball games.

A principle object of the present invention is to provide a device that illuminates luminescent paintballs before the balls are urged into a discharge mechanism of a paintball "gun"; the conduit portion ultimately directing the paintballs into a discharge mechanism in the gun. A feature of the device is a modified conduit that includes a plurality of ultraviolet lamps inserted therein. An advantage of the device is that the paintballs are orientated into a single row for maximum exposure to the ultraviolet lamps before being projected from the paintball gun resulting in paintballs that provide a bright, visible glow after being projected from the gun thereby facilitating a luminous trail or "tracer effect" for enhanced safety, fair play and entertainment during the paintball contest.

Another principle object of the present invention is to provide a device that illuminates large quantities of luminescent paintballs while in a container and before the balls are projected down the barrel of a paintball gun. A feature of the device is a hopper that includes a plurality of ultraviolet lamps disposed about an inner portion of the hopper. An advantage of the device is that a large quantity of paintballs are continuously exposed to ultraviolet light resulting in light emanating from the paintballs after being projected from a paintball gun thereby facilitating a luminous trail or "tracer effect" for enhanced visual entertainment and shooting accuracy, and further facilitating target marking. Another advantage of the device is that the enclosed paintballs "share" ultraviolet light between adjacent glowing paintballs while exposed to the ultraviolet light source and after the ultraviolet light has been removed.

Another object of the present invention is to provide a device that disposes the ultraviolet lamps about an inner portion of a conduit. A feature of the device is a bracket configured to cooperate with the periphery of the conduit. An advantage of the device is that the lamps are quickly positioned about the conduit by the bracket.

Yet another object of the present invention is to provide a device that allows the lamps to insert into the conduit. A feature of the device is a plurality of apertures through predetermined portions of the conduit. An advantage of the device is that the lamps are disposed in close proximity to the paintballs thereby receiving a relatively large quantity of ultraviolet light.

Another object of the present invention is to provide a device that prevents engagement between the ultraviolet lamps inserted into the conduit and the paintballs. A feature of the device is a guard member disposed adjacent to each lamp. An advantage of the device is that the guard member is configured to protect the lamp while allowing the paintball to move unobstructedly through the conduit and past the lamp.

Another object of the present invention is to provide a device that is safe for an operator of a paintball gun. A feature of the device is a low power source for energizing all the ultraviolet lights. An advantage of the device is that a night paintball contestant does not have to wear protective equipment to avoid electric shock when participating in a night paintball game.

Another object of the present invention is to provide a device that is relatively inexpensive. A feature of the device is the small quantity of electrical components utilized to light activate the phosphorescent paintballs. An advantage of the device is that day paintball participants can play night paintball for substantially the same costs by incorporating the device into standard daytime paintball equipment.

Another object of the present invention is to provide a device that is mechanically durable when exposed to extreme movements. A feature of the device is the ability of the electrical components to withstand mechanical vibrations. An advantage of the device is a decrease in failure rates for charging luminescent paintballs.

Another object of the present invention is to provide a device that promotes the enclosing of all electrical components. A feature of the device is small electrical components and ultraviolet lights. An advantage of the device is the prevention of physical contact between the electrical components and an opponent's projected paintballs. Another advantage is that expensive sensory devices are eliminated. Yet another advantage of the device is that the paintball gun's weight distribution is improved along with "shooting" accuracy by not placing "charging" equipment on the paintball gun barrel.

Briefly, the invention provides a device for illuminating luminescent paintballs before the balls are projected down the barrel of a paintball gun comprising paintball containment means; means for illuminating the luminescent paintballs while disposed in said containment means; means for disposing said illuminating means at preselected portions of said containment means; and means for energizing said illuminating means whereby the luminescent paintballs provide a tracer effect when the luminescent paintballs are discharged from a paintball gun.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1:
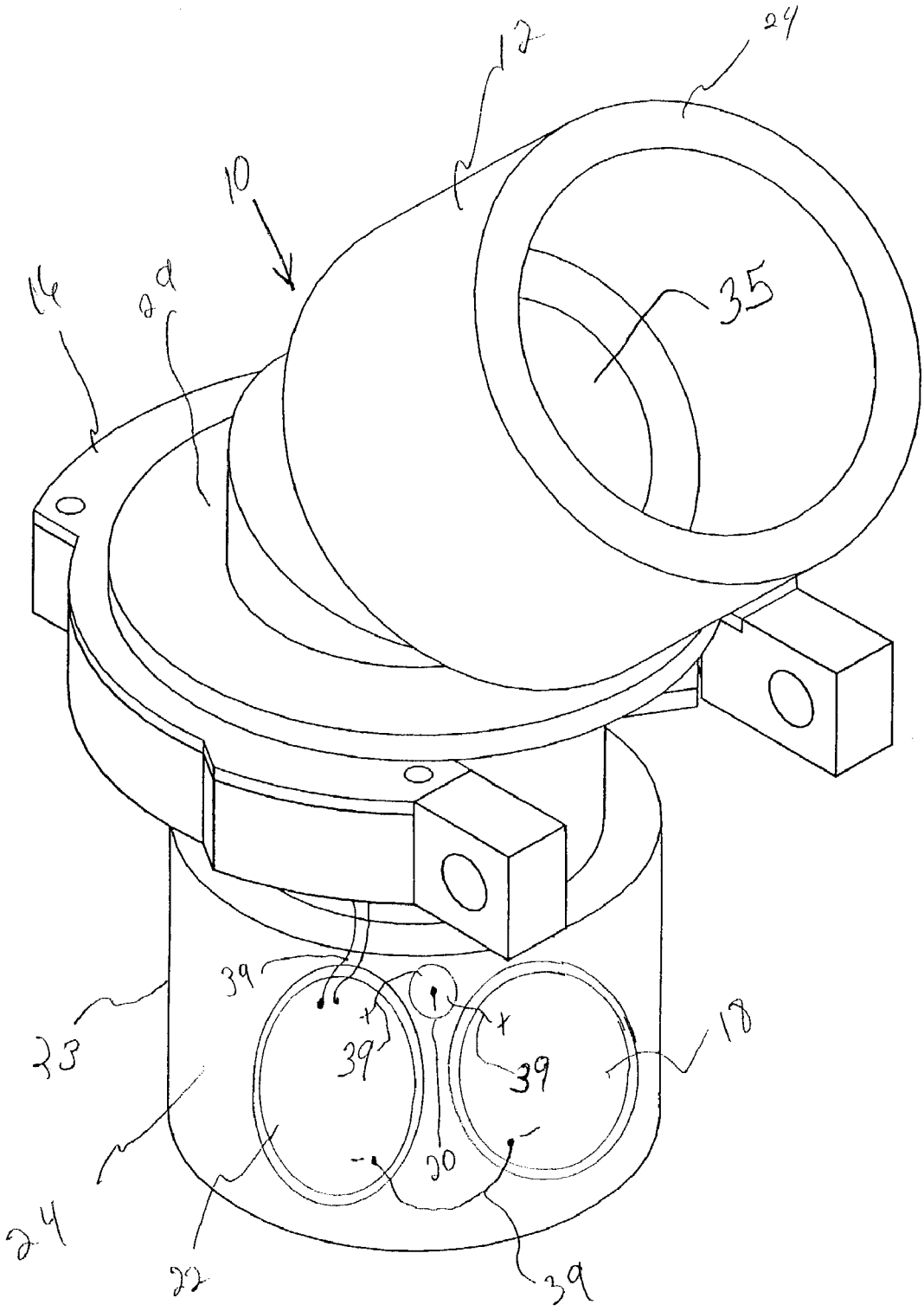
FIG. 1 is a perspective view of a device for illuminating luminescent paintballs while disposed in a conduit portion of a paintball discharge mechanism in accordance with the present invention.
Figure 2:
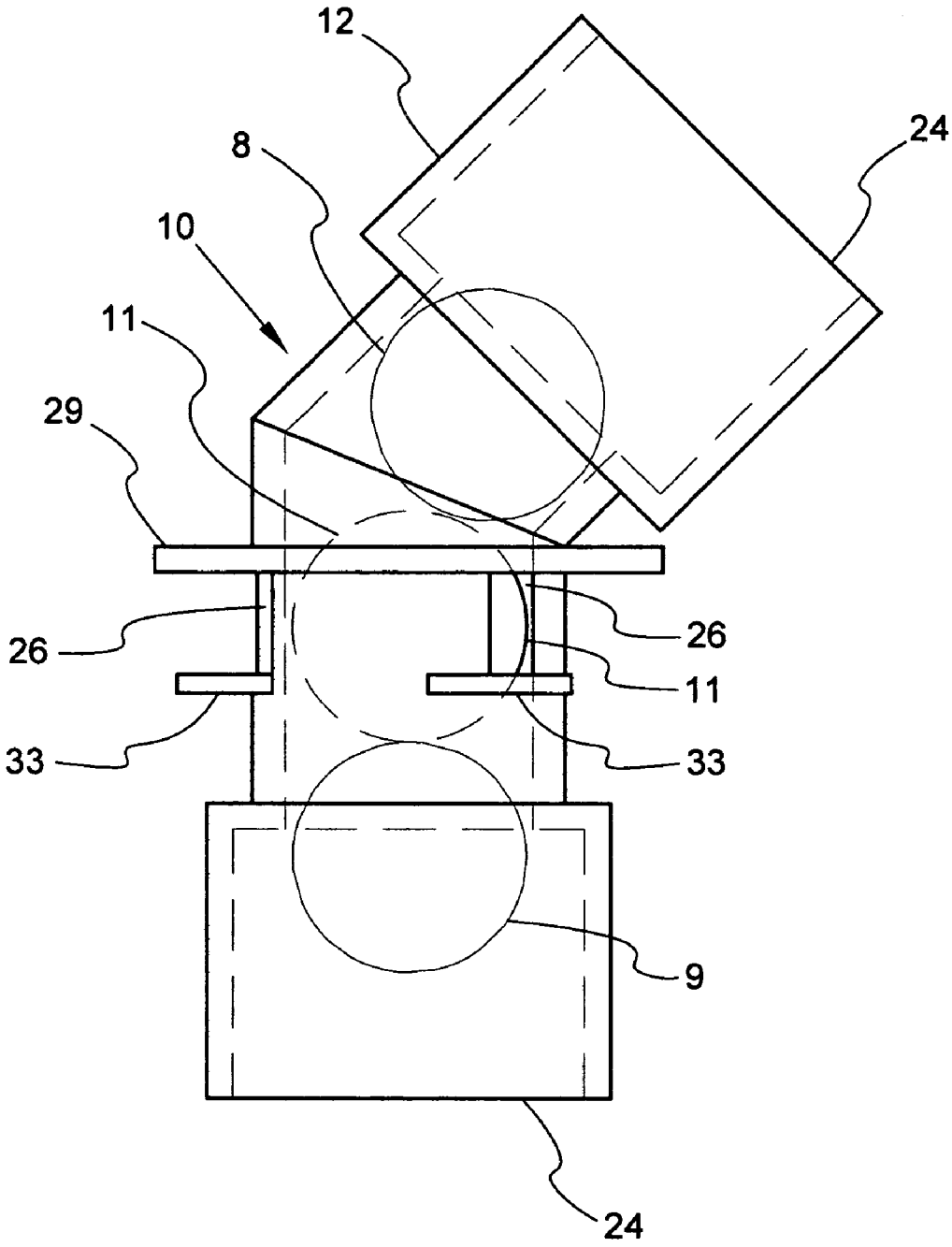
FIG. 2 is a side elevation view of FIG. 1, but with a horseshoe configured bracket removed and phantom luminescent paintballs added.
Figure 3:
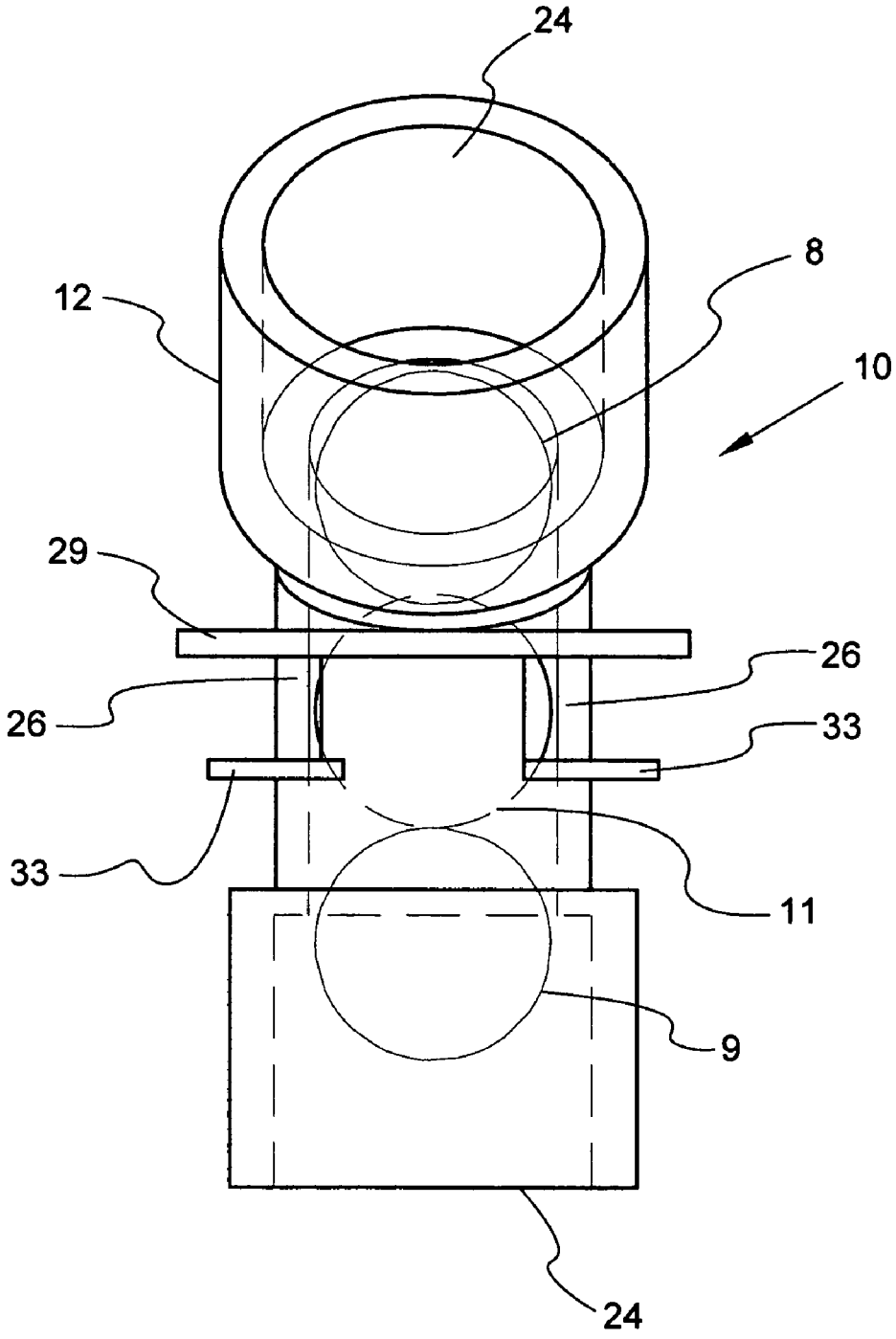
FIG. 3 is a front elevation view of FIG. 2.
Figure 4:
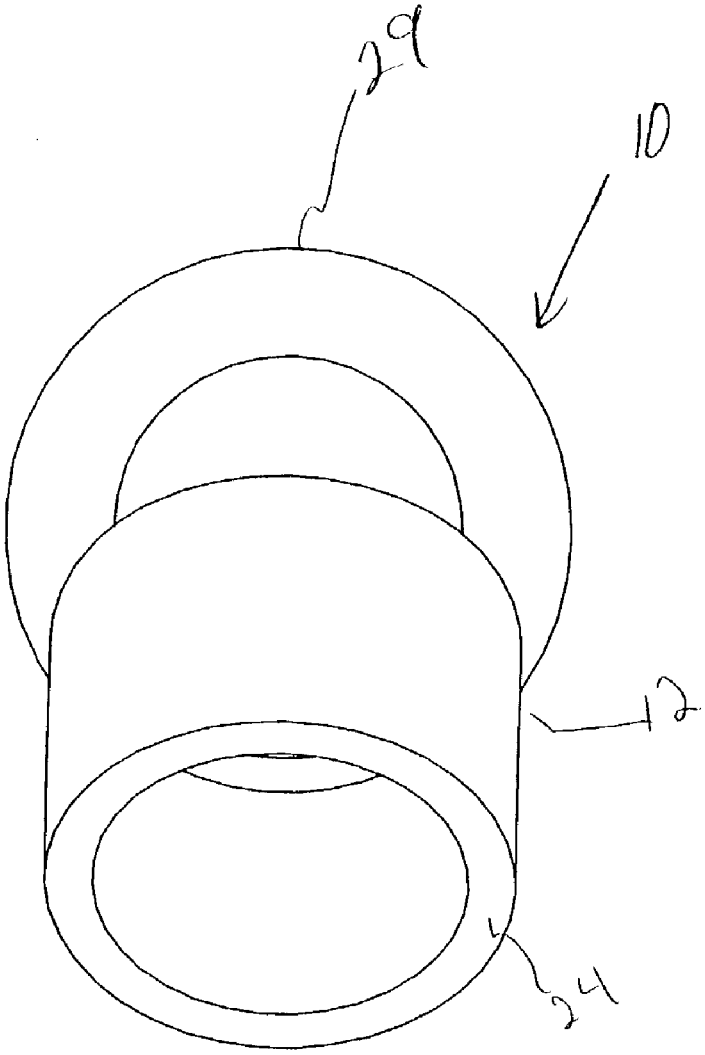
FIG. 4 is a top elevation view of FIG. 2.
Figure 5:
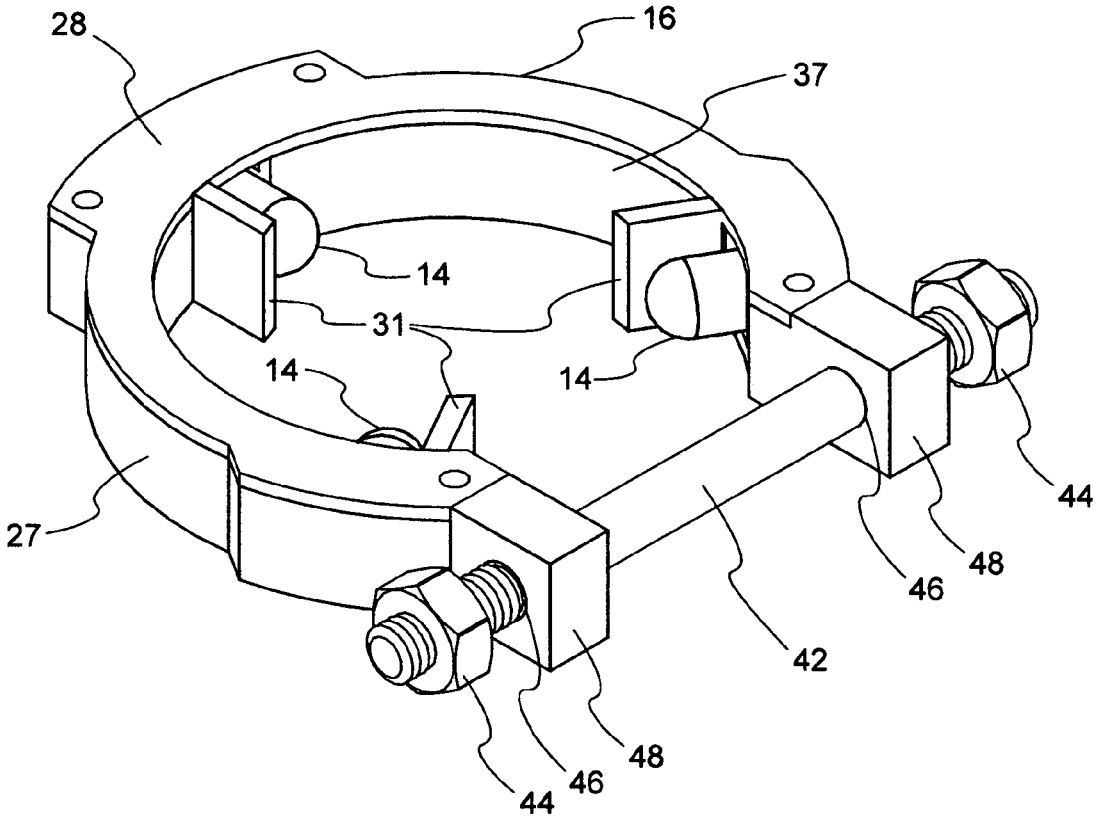
FIG. 5 is a perspective view of a bracket member of the device of FIG. 1 in accordance with the present invention.
Figure 6:
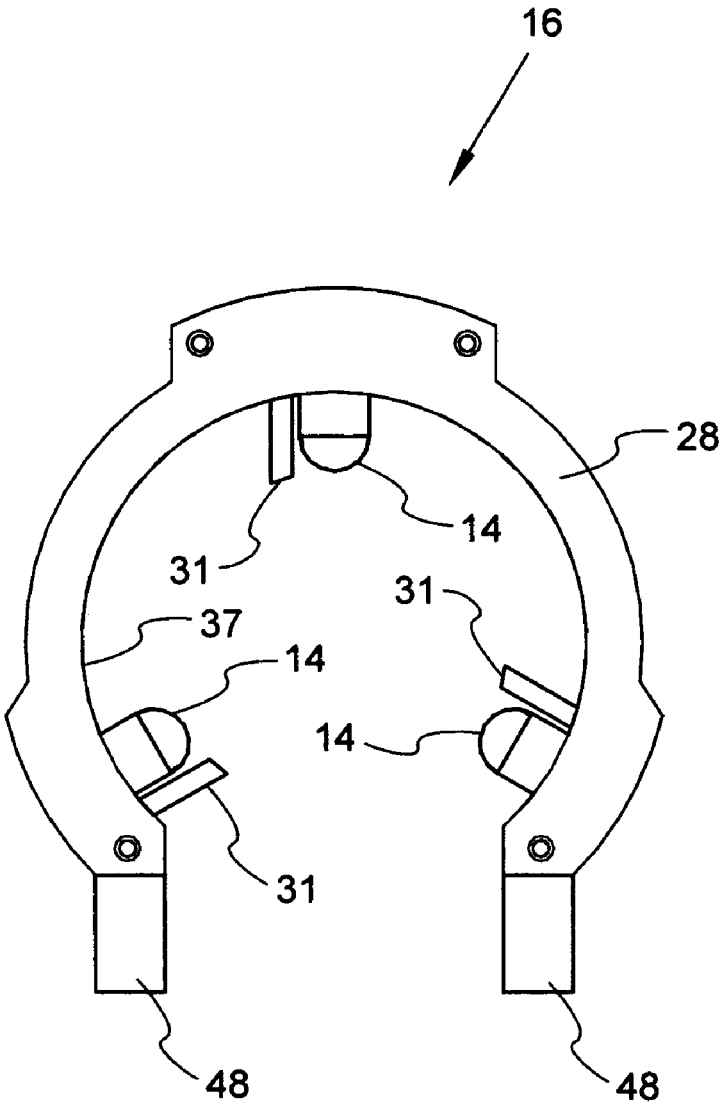
FIG. 6 is top view of the bracket member of FIG. 5.
Figure 7:
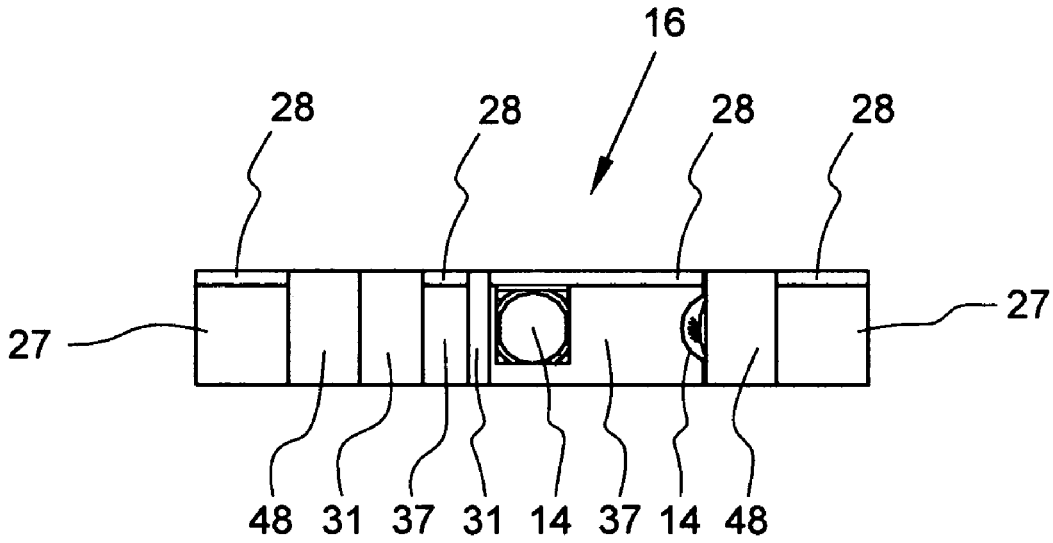
FIG. 7 is a front elevation view of the bracket member of FIG. 5.
Figure 8:
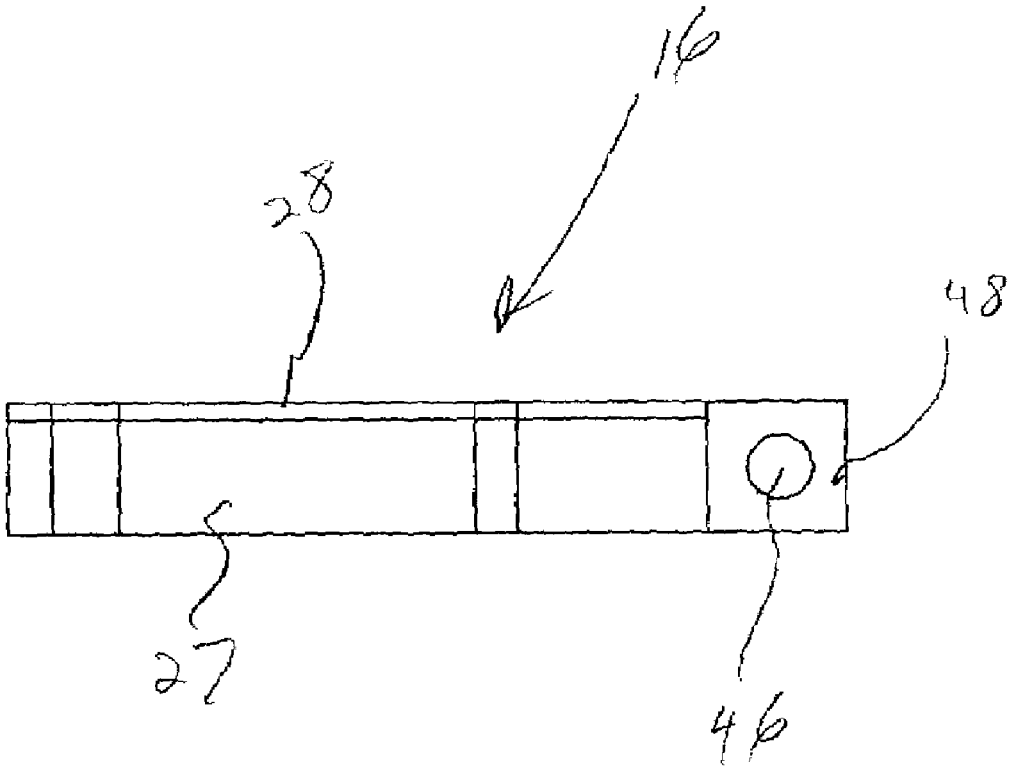
FIG. 8 is a side elevation view of the bracket member of FIG. 5.
Figure 9:
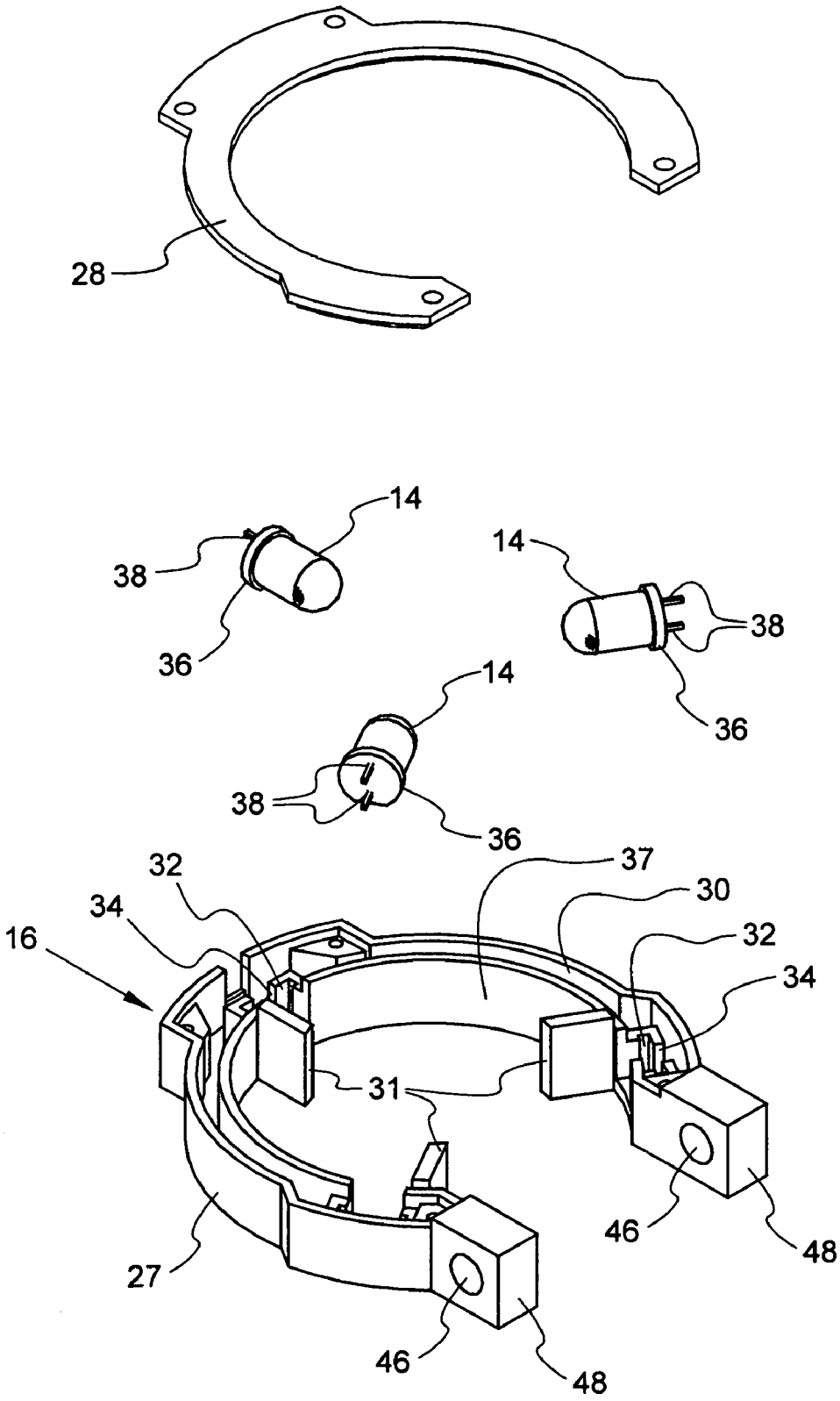
FIG. 9 is an exploded perspective view of the bracket member of FIG. 5.

Referring now to the drawings and in particular to FIGS. 1–9, a device for illuminating luminescent paintballs 11 before the balls are urged into a discharge mechanism (not shown) of a paintball gun (not pictured) is denoted by numeral 10. The paintball device 10 includes a conduit 12 configured to form proximately a forty-five degree angle to promote the substitution of the present device 10 with a conduit portion of a typical paintball gun. Although the conduit 12 is depicted as being "bent," alternative configurations including vertical and horizontal may be utilized. The device 10 further includes a plurality of ultraviolet lamps 14 disposed about an inner portion of the conduit 12 to illuminate or "charge" the luminescent paintballs thereby causing the paintballs to "glow" in the dark; a "horseshoe" configured bracket 16 that disposes the lamps 14 at preselected portions of the conduit 12 to maximizes the exposure of the paintballs to ultraviolet light from the lamps 14; and a low voltage D.C. battery 18, an on-off switch 20 and an inverter 22 adjacently disposed and attached to an outer wall 23 of the conduit 12; the battery 18, on-off switch 20 and inverter 22 cooperating to provide a stepped up R.M.S. voltage to the lamps 14.

Referring to FIGS. 1–4, the conduit 12 is fabricated from plastic or metal and includes enlarged end portions 24 that snugly receive cooperating portions 86 of a hopper 50 (see FIG. 14) and a discharge mechanism (not shown) of a typical paintball gun. The conduit 12 has three apertures 26 radially disposed and spaced apart substantially equal distances about a mid-portion of the conduit 12 to receive corresponding ultraviolet lamps 14 and guard members 31 thereby facilitating the insertion of the lamps 14 and guard members 31 into the interior of the conduit 12 to ultimately position the lamps 14 adjacent to the paintballs 11 for maximum ultraviolet light exposure as the paintballs 11 move through the conduit 12. Although three lamps 14 is the preferred configuration of the present invention, a greater or lesser quantity of lamps having a myriad of configurations 14 may be used so long as the paintballs 11 are exposed to ultraviolet light of substantially the same intensity and time period such that the tracer effect generated by a projected paintball is visible to night paintball participants. Further, added lamps 14 may be disposed in the paintball guns projection chamber or in the breech of the gun should increased exposure to ultraviolet lighting be required to provide a more intense luminous trail.

The conduit 12 further includes an annular plate 29 circumferentially disposed above the apertures 26 to engage and provide stability to the bracket 16 when the bracket 16 is secured to the conduit 12. The bracket 16 is further stabilized by a plurality of arcuate support members 33 disposed beneath the bracket 16 to engage and maintain the position of the bracket 16 relative to the conduit 12. Three guard members 31 (FIGS. 5 and 6) are disposed adjacent to corresponding lamps 14 and integrally joined to a inner cylindrical wall 37 of the bracket 16 to protect the lamps 14 by reducing the number of "collisions" between the lamps 14 and the paintballs without obstructing movement of the paintballs 11 through the conduit 14. The inner cylindrical wall 35 of the conduit 14 is coated with reflective material such as chrome paint or light reflective plastic to reflect and maintain ultraviolet light inside the conduit to better activate the luminescent material inside the paintballs 11 thereby inducing the paintballs 11 to generate more light.

Referring to FIGS. 5–9, the horseshoe configured bracket 16 includes a channel portion 27 and a removable top potion 28 that covers a wire channel 30 in the channel portion 27. The bracket 16 is configured to cooperate with the periphery of the conduit 12 thereby allowing a myriad of bracket 16 configurations to be utilized to position the lamps 14. The lamps 14 are forcibly secured to the channel portion 27 via base and connector slots 32 and 34 cooperating with corresponding base and connector portions 36 and 38 of the lamps 14. The base slot 32 snugly receives the base portion 36 of the lamp 14 after vertically aligning the connector portions 38 of the lamps 14 with the connector slot 34. Wires 39 routed through the channel 30 ultimately connect to the connector portions 38 such that the lamps 14 are wired "in parallel" thereby maintaining illumination of functioning lamps 14 in the event that one or more lamps 14 should fail. Guard members 31 integrally joined to the inner cylindrical wall 37 of the channel portion 27 and disposed adjacent to the lamps 14, are dimensioned to snugly insert into corresponding apertures 26 in the conduit 12 to maintain the position of the bracket 16 relative to the conduit 12 during operation of the paintball 11 discharge mechanism. The bracket 16 is ultimately secured to the conduit 12 by a retaining bolt 42 and nuts 44 inserted through apertures 46 in cooperating opposing end portions 48 separated a predetermined distance that allows the bracket 16 to removably receive the conduit, the end portions 48 ultimately being detachably joined together.

Figure 10:
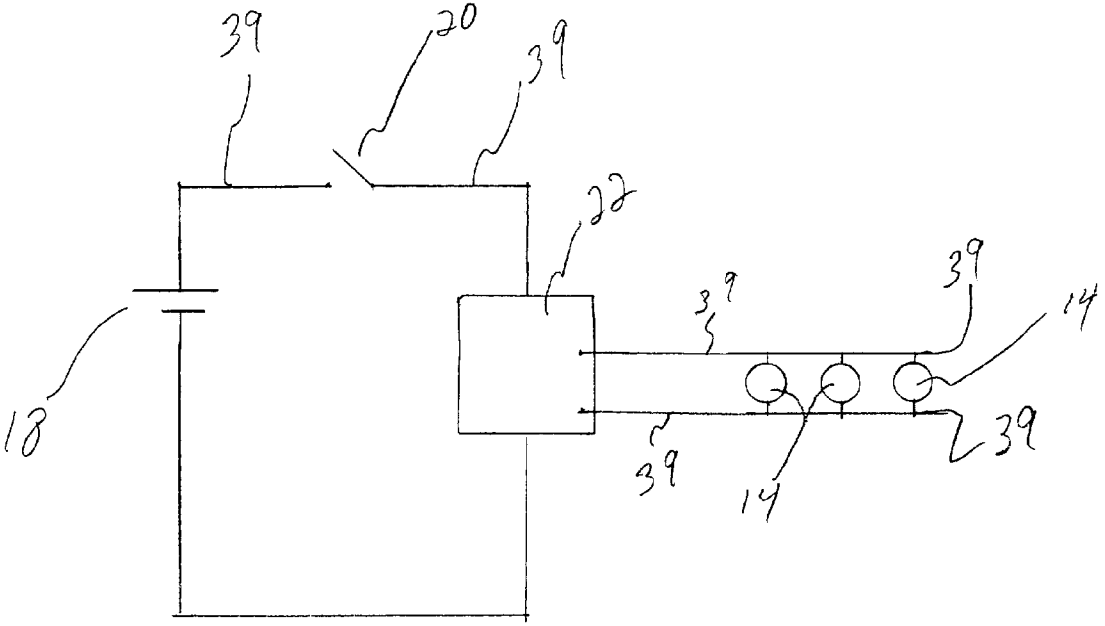
FIG. 10 is a schematic diagram of electrical components of the device in accordance with the present invention.
Figure 11:
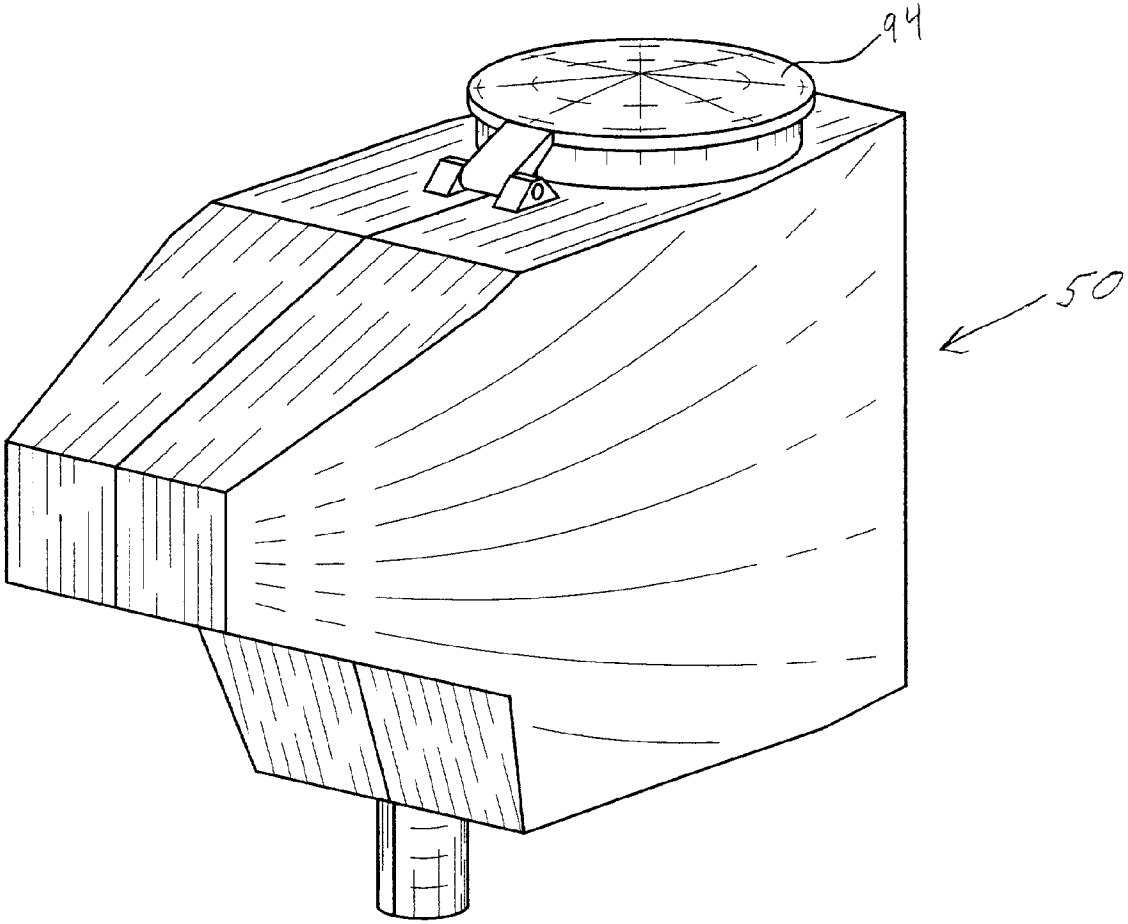
FIG. 11 is a perspective view of a hopper portion of a paintball discharge mechanism, the hopper portion containing luminescent paintballs that are ultimately exposed to illuminating means that "charge" the luminescent paintballs while disposed in the hopper in accordance with the present invention.

The lamps 14 may be ultraviolet light emitting diodes or cold cathode ultraviolet lights or similar ultraviolet lights capable of providing light intensity comparable to that of a 50 millimeter long, 3 millimeter diameter narrow spectrum miniature ultraviolet cold cathode flourescent lamp, model BF 350-UV1, manufactured by JKL Components Corporation of 13343 Paxton St., Pacoima Calif., 91331. The lamps 14 are illuminated via a 650 volt R.M.S. output from an inverter-power supply 22 manufactured by JKL Components Corporation. The power input to the inverter 22 is provided by one or more 3 volt lithium batteries 18 secured to the conduit 12. Power to the battery 18 and inverter 22 is ultimately controlled via a micro toggle switch 20 well known to those of ordinary skill in the art (see FIG. 10). Although ultraviolet lights are the preferred components for illuminating the paintballs 11, alternative lighting elements for charging the paintballs 11 include high intensity mercury vapor and halogen.

In operation, the device 10 replaces the conduit portion of a daytime paintball gun thereby retrofitting the daytime paintball gun for night paintball usage. Alternatively, the device 10 is included in the manufacturing process of a paintball gun specifically built for night paintball. The night paintball gun includes a hopper or similar paintball storage member that receives a plurality of luminescent paintballs 11 that are urged via gravity or assist feeds from the hopper into the conduit 12 of the device 10 to form a single line of paintballs 11. The conduit 12 may also be used to extend the charging time for paintballs that have been initially exposed to ultraviolet lighting inside the hopper before being urged into the conduit 12. This is an important feature during periods when paintballs are not being "shot." Once the paintballs drop into the conduit 12, the toggle switch 20 is positioned to provide power from the battery 18 to the inverter 22 thereby energizing the lamps 14 and engulfing the paintballs 11 in the conduit 12 with ultraviolet light. The paintballs 11 become luminous or "glow" after a few seconds of exposure to the ultraviolet light whereupon a first paintball 9 drops from the conduit 12 into a discharge mechanism and a hopper paintball 8 drops into the conduit 12.

The hopper paintball 11 is activated by the ultraviolet light while the first paintball 11 is projected through a barrel portion of the paintball gun and provides a luminous trail visible to paintball participants in the field of play. The exposure time of the paintball 11 to ultraviolet light in the conduit 12 (about ten seconds) is such that the paintball 11 provides not only a luminous trail, but also a luminous paint pattern on a target after an outer shell of the paintball 11 ruptures upon striking the target. The luminous paint pattern continues glowing for several minutes after impact to allow sufficient time for field judges to inspect for "hits" between opposing teams of paintball participants.

Referring now to FIGS. 11–17, a hopper device for illuminating luminescent paintballs 11 before the balls 11 are urged into a discharge mechanism of a paintball gun (not shown) is denoted by numeral 50. The hopper device 50 includes a typical hopper shell 52 well known to those of ordinary skill in the art, top and bottom rows 54 and 56 of ultraviolet lights 14 disposed at preselected portions of the shell 52 to maximize the exposure of the paintballs 11 to ultraviolet light emitted from the lights 14, a pair of low voltage D.C. batteries 58 that supply power via an "on-off" micromini toggle switch 60 to an invertor 62 which increases the voltage to a magnitude utilized by the lights 14. A myriad of hopper device 50 configurations may be utilized for night paintball. The optimum placement of ultraviolet lights 14 to illuminate paintballs 11 within the chosen hopper configuration is determined via trial and error.

The hopper shell 52 includes an inner wall 64 coated in an aluminum or chrome paint or plastic to create a mirrored or highly reflective interior that promotes reflected ultraviolet light within the shell 52 thereby engulfing all inner portions of the shell 52 and all luminescent paintballs 11 therein with ultraviolet light that activates the paint inside the paintballs 11 causing the balls 11 to glow in relatively dark playing conditions. The hopper shell 52 may be one of a myriad of configurations well known in the industry for day paintball contests, or may be a new design specifically formed for uniformly distributing ultraviolet light throughout the internal cavity of the hopper shell 52.

The hopper shell 52 further includes battery and inverter chambers 66 and 68 to house and protect the batteries 58 and inverter 62 from inclement weather and paintballs 11 fired from "enemy" participants. The shell 52 and chambers 66 and 68 are fabricated from plastic or comparable lightweight, durable material, and configured by joining two similar half-portions manufactured via a dye and mold process well known in the industry. The chambers 66 and 68 may be integrally fabricated with the shell 52, or may be fabricated as discrete components and secured to the shell 52 via setscrews. The batteries 58 and inverter 62 are mounted inside the respective chambers 66 and 68 via screws, clamps, adhesives or similar securing elements commonly used in the industry. Removable panels 70 and 72 provide access to the battery and inverter chambers 66 and 68, respectively. The inverter chamber panel 72 includes apertures that allow the toggle switch 60, which is secured to the inverter 62, and a "power on" light 74 to protrude through the panel 72 and interact with the user of the hopper device 50.

Figure 13:
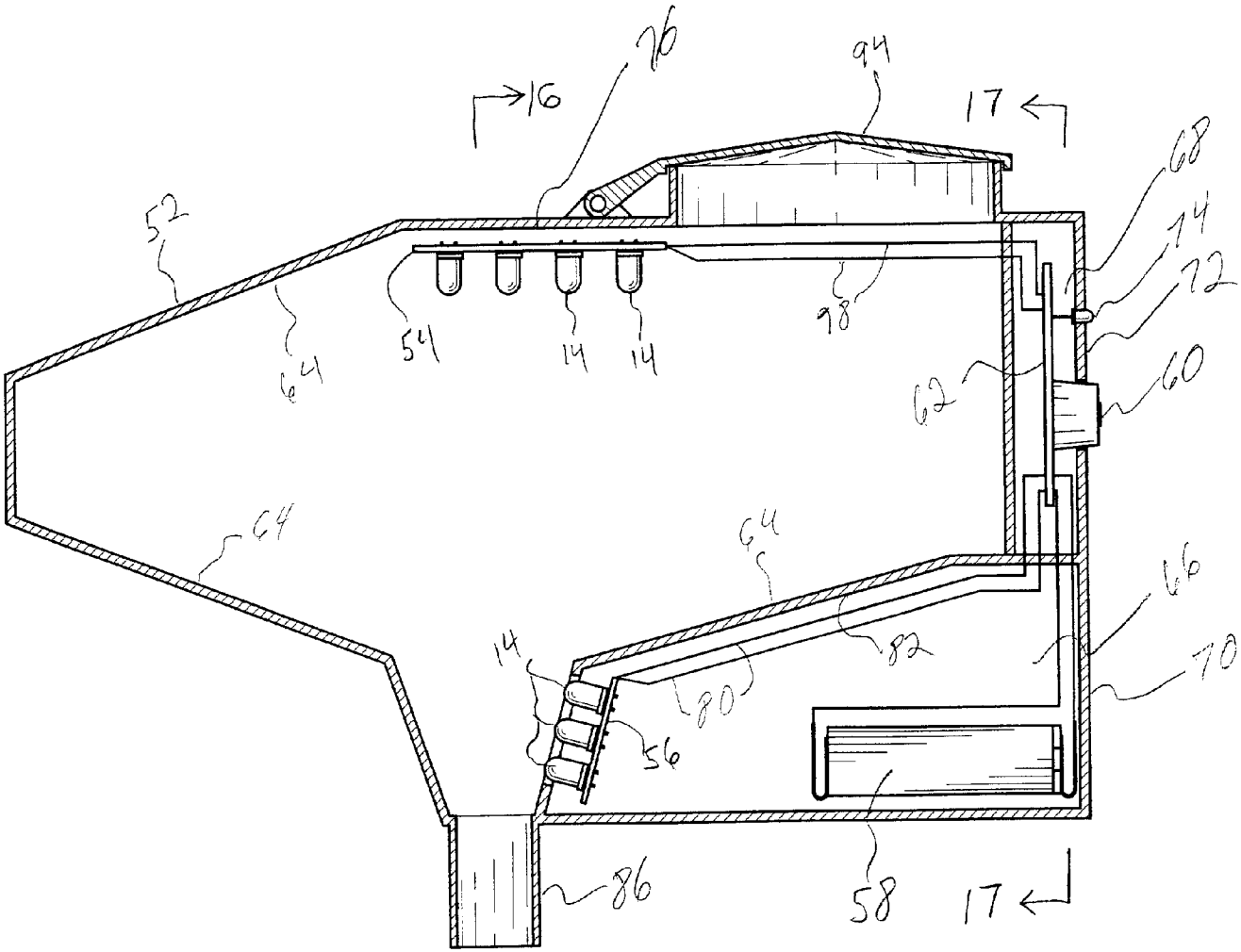
FIG. 13 is a side elevation view of the hopper portion of FIG. 10 with no paintballs contained therein.
Figure 14:
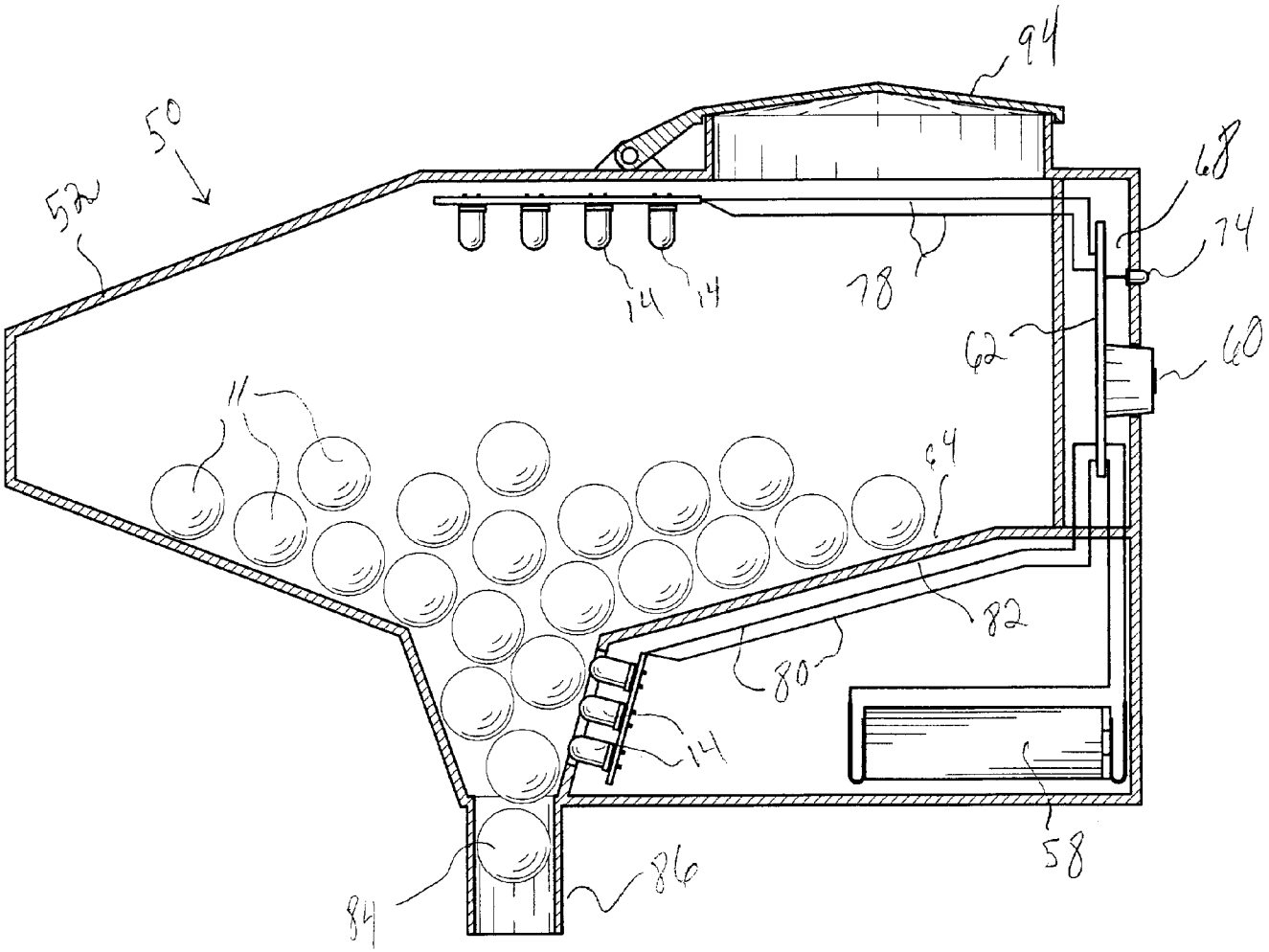
FIG. 14 is the same side elevation view depicted in FIG. 12, but with a plurality of paintballs contained therein.
Figure 15:
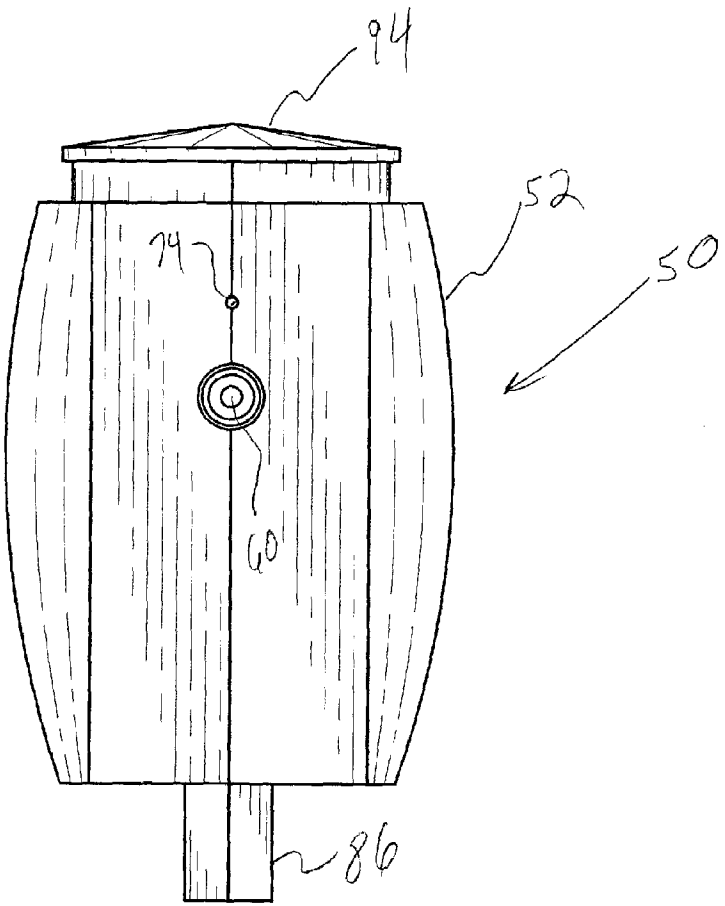
FIG. 15 is a back elevation view of the hopper portion of FIG. 10.
Figure 16:
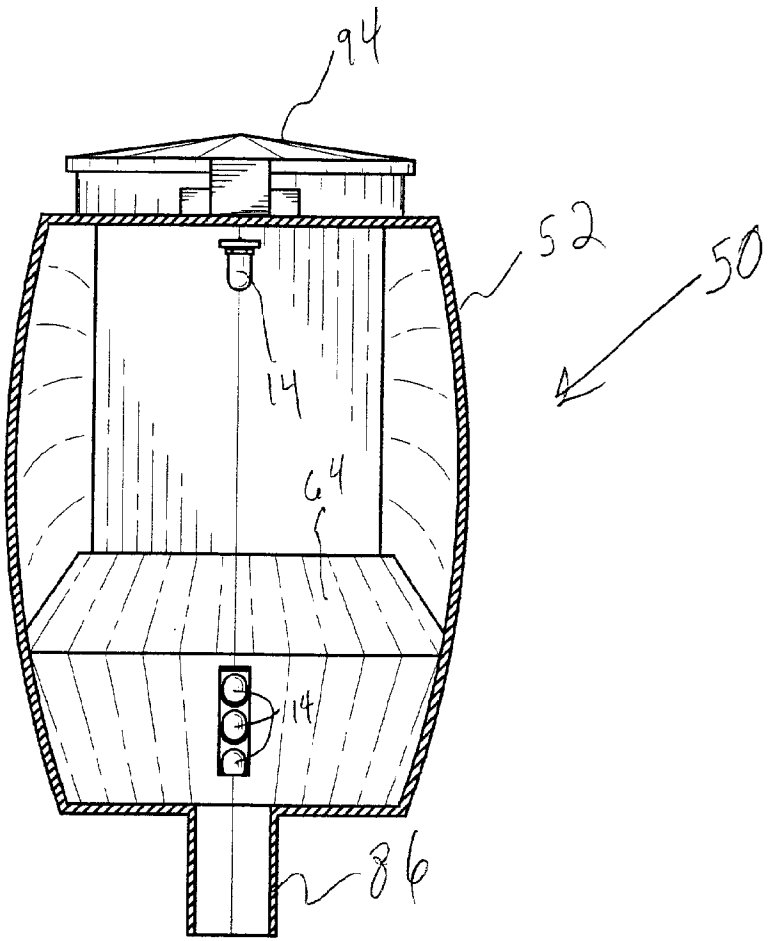
FIG. 16 is a sectional view of the hopper portion taken along line 16—16 of FIG. 12.
Figure 17:
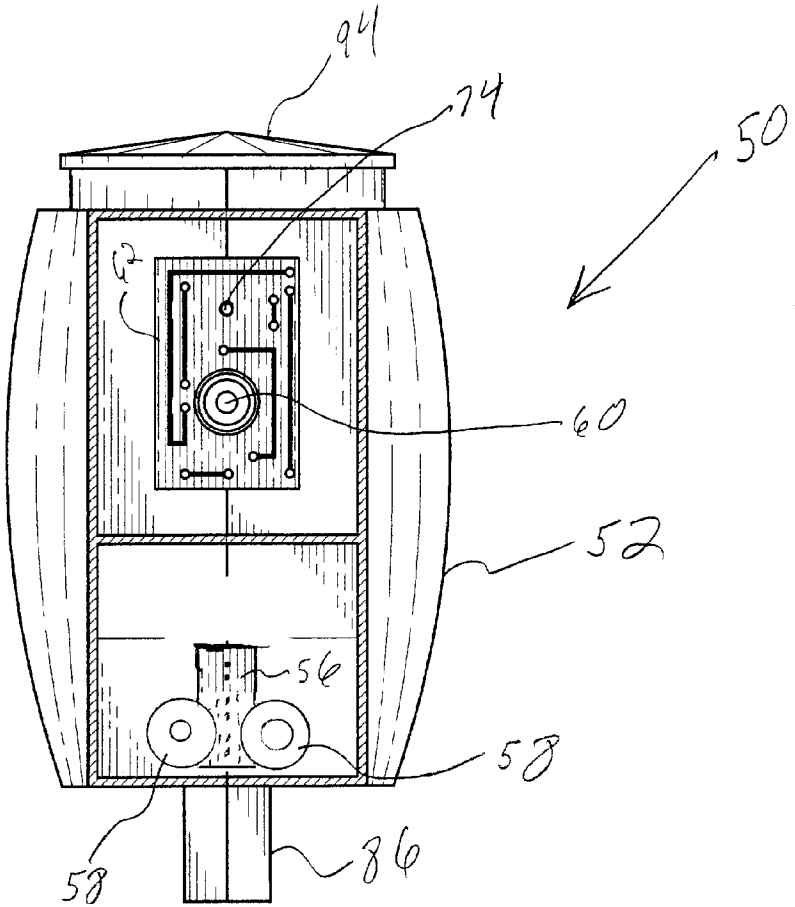
FIG. 17 is a sectional view of the hopper portion taken along line 17—17 of FIG. 12.

The ultraviolet lights 14 are required to provide about a three-hundred and sixty-five nanometer wavelength, although shorter or longer wavelengths will cause the paintballs 11 to glow with less intensity. Suitable ultraviolet lights 14 have a part number BF 350-UV1 and are manufactured by JKL Components Corporation of St. Paceima Calif. Alternatively, light emitting diodes (LED's) may be used so long as the ultraviolet light specifications are maintained. The top row 54 of lights 14 are secured to the inner wall 64 of the shell 52 via set screw or similar joining elements. The lights 14 of the top row 54 may be orientated in a direction opposite to the top portion 76 as depicted in FIGS. 13 and 14, or the lights 14 may be orientated such that each light 14 of the top row 54 is directed toward a different internal portion of the shell 52 resulting in a more uniform illumination of all the paintballs 11 inside the shell 52 and causing the paintballs 11 to glow at a constant intensity. The lights 14 in the top row 54 are energized via wires 78 secured to a top portion of the inner wall 64 of the shell 52 and connected to the inverter 62.

The bottom row 56 of ultraviolet lights 14 are secured to a bottom portion of the shell 52 such that an end portion of the lights 14 insert into cooperating apertures whereby the lights 14 illuminate but do not engage the paintballs 11 as the paintballs are gravity fed into the discharge mechanism of the paintball gun. The lights 14 in the bottom row 56 are energized via wires 80 secured to a battery chamber wall 82 and connected the inverter 62. The placement of the wires 80 in the battery chamber 66 prevents the wires from obstructing movement of paintballs 11 from the hopper device 50 to a discharge mechanism, standard conduit or the conduit 12 of the illuminating device 10 detailed above. The wiring scheme for the batteries 58, toggle switch 60, inverter 62 and power on light 74 is depicted in FIG. 18.

When operating a paintball gun during night paintball with a hopper device 50 but without including the conduit device 10 detailed above, a relatively large quantity of luminescent paintballs 11 are illuminated simultaneously with ultraviolet light by disposing the paintballs 11 inside a hopper device 50 having ultraviolet or similar high intensity lighting therein. The paintballs 11 substantially fill the typical hopper shell 52 of a paintball gun (see FIG. 14). A toggle switch 60 is positioned to energize and illuminate top and bottom rows 54 and 56 of ultraviolet lights 14. As the paintball gun begins to discharge paintballs 11, the first projected paintball 84 will glow very little due to the paintball 84 being disposed in a discharge port 86 or conduit where little ultraviolet light will reach. As more paintballs 11 are discharged, the glow intensity increases resulting in a visible tracer effect for the paintball participants. When the paintballs 11 strike a target, the outer shell ruptures allowing the glowing paint therein to spread upon the target and assist a judge or referee during a night paintball game to acknowledge a "hit" by the "shooter" of the luminescent paintball 11.

Professional night paintball games may require all luminescent paintballs 11 discharged from a paintball gun to glow sufficiently to allow a referee to record a hit upon an opposing participant. To illuminate the paintballs 84 in the discharge port 86 or in the conduit of a typical paintball gun, the above described illumination device 10 which includes a conduit 12 should be combined with the hopper device 50 thereby providing ultraviolet light to all luminescent paintballs 11 before the balls 11 are urged or dropped into the discharge mechanism of a paintball gun.

Figure 12:
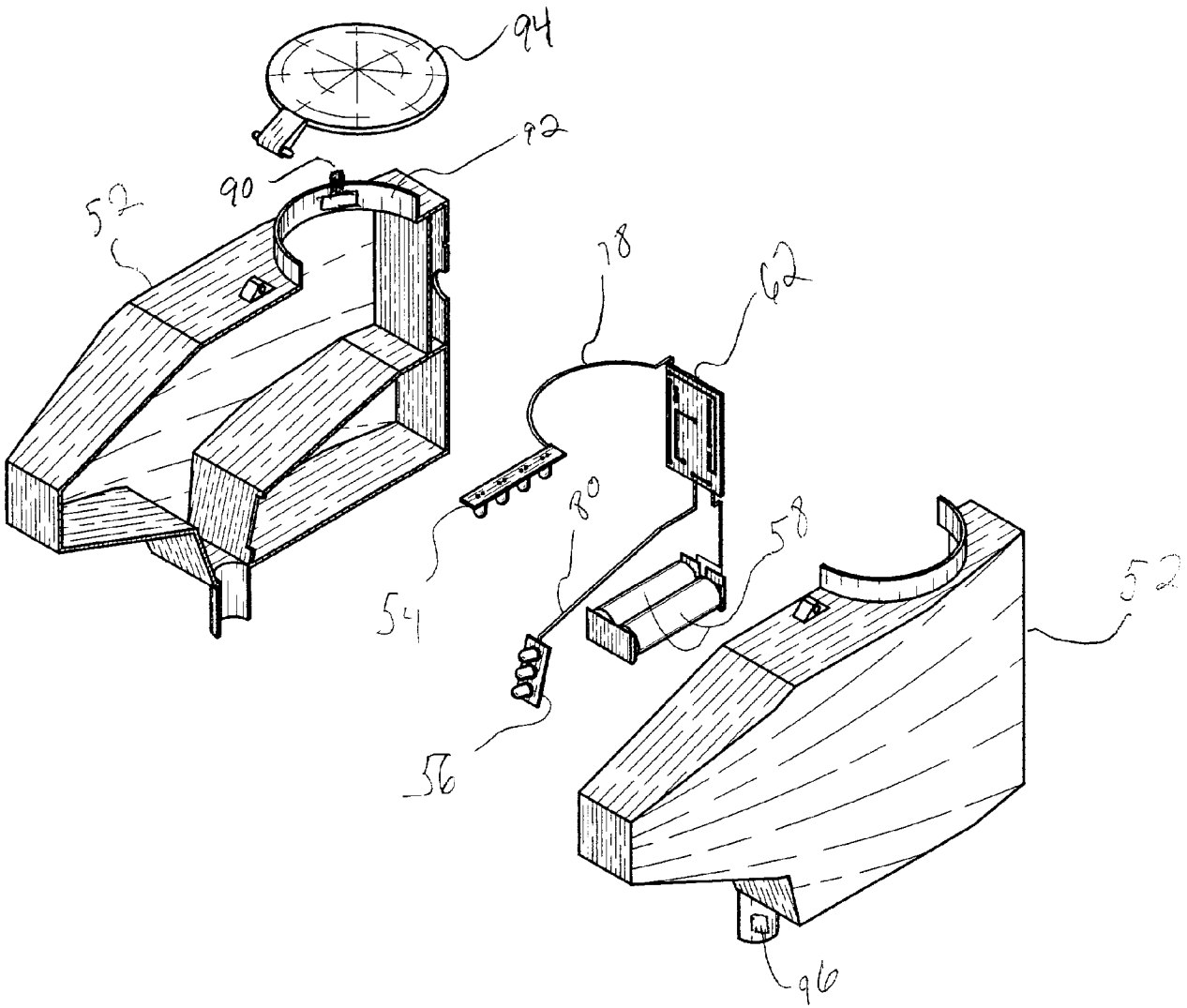
FIG. 12 is an exploded perspective view of the hopper portion of FIG. 10.
Figure 18:
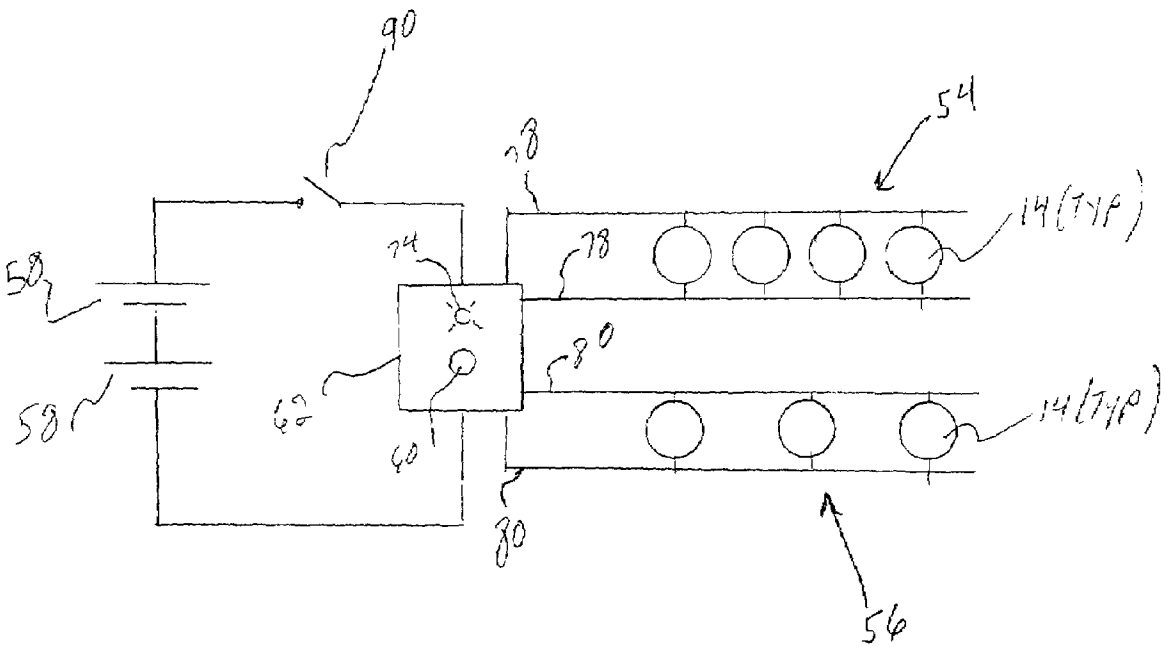
FIG. 18 is a schematic diagram of electrical components of a hopper device in accordance with the present invention.

Referring now to FIGS. 12 and 18, an on-off switch 90 may be secured to the rim portion 92 of the hopper shell 52 such that when the lid 94 is lifted off the switch 90 and rim 92, the switch 90 opens the circuit from the batteries 58 to the inverter 62 and de-energizes the ultraviolet lights 14 thereby preventing a user's eyes from being exposed to ultraviolet light when filling the hopper shell 52. Continued exposure to ultraviolet light can be detrimental to the vision of some players. Although the manually activated switch 60 on the inverter 62 can be positioned to cut-off power, a player will sometimes forget to turn off the power to the ultraviolet lights 14 when filling the shell 52. Along with adding a switch 90 to the device 50, a viewing window 96 may be added to the discharge port 86 to allow a user to determine if paintballs need to be added to the device 50.

The foregoing description is for purposes of illustration only and is not intended to limit the scope of protection accorded this invention. The scope of protection is to be measured by the following claims, which should be interpreted as broadly as the inventive contribution permits.

What is claimed is:

1. A hopper device for illuminating luminescent paintballs comprising;

an enclosure having an inlet and outlet, said enclosure being adapted to be secured to a paintball projecting device;

means for illuminating the paintballs;

means for disposing said illuminating means at predetermined positions relative to said enclosure; and means for energizing said illuminating means.

2. The device of claim 1 wherein said enclosure includes an internal light reflective surface that reflects light within said enclosure to increase the luminescence of the paintballs while inside said enclosure.

3. The device of claim 1 wherein said illuminating means includes at least one ultraviolet cold cathode flourescent light.

4. The device of claim 1 wherein said illuminating means includes two ultraviolet lights disposed at top and bottom portions of said enclosure.

5. The device of claim 1 wherein said disposing means includes means for positioning said illuminating means such that said illuminating means do not obstruct movement of the paintballs while inside said hopper device.

6. The device of claim 5 wherein said positioning means includes means for securing said illuminating means to a bottom portion of said enclosure such that an end portion of said illuminating means insert into cooperating apertures whereby said illuminating means illuminate but do not engage the paintballs as the paintballs are gravity fed into a discharge mechanism of a paintball gun.

7. The device of claim 1 wherein said enclosure includes internal walls that reflect ultraviolet light within said enclosure thereby maintaining said ultraviolet light inside said enclosure to increase the luminescence of the paintballs.

8. The device of claim 7 wherein said internal walls are coated with aluminum or chrome paint or a plastic mirrored material or combinations thereof.

9. The device of claim 1 wherein said energizing means includes at least one battery, an inverter, an on-off switch and means for electrically connecting said illuminating means to said inverter.

10. The device of claim 1 wherein said enclosure includes a viewing window to allow a user to determine if paintballs are present in a discharge port of said hopper device.

11. The device of claim 1 wherein said enclosure includes funnel means that cooperates with said outlet of said enclosure to orientate the paintballs into a single row whereupon the paintballs are disposed into a paintball discharge mechanism.

12. The device of claim 1 wherein said energizing means is removably secured to said enclosure.

13. The device of claim 1 wherein said enclosure inlet includes a cover.

14. The device of claim 1 wherein said energizing means includes a toggle switch secured to an inverter.

15. The device of claim 13 wherein said cover cooperates with a power cut-off switch to de-energize said illuminating means when said cover is removed from said enclosure.

16. The device of claim 1 wherein said enclosure includes access to internal illuminating means.

17. The device of claim 1 wherein said enclosure includes means for preventing wires from obstructing movement of paintballs.

18. The device of claim 1 wherein said enclosure includes an on-off switch that de-energizes said illuminating means when a lid is lifted to fill said hopper device thereby preventing a user's eyes from being exposed to ultraviolet light.

19. A device for charging luminescent paintballs comprising:

an enclosure having means for receiving and dispersing paintballs, said enclosure being adapted to be secured to a paintball dispersing device;

means for illuminating the paintballs while inside said enclosure; and means for energizing said illuminating means whereby the paintballs glow for a predetermined time after being dispersed from said enclosure.

20. A device for providing luminescent paintballs to a paintball gun comprising:

a hopper adapted to be secured to a paintball gun;

means for illuminating an inner cavity of said hopper with ultraviolet light; and means for energizing said illuminating means whereby the paintballs become luminescent thereby providing a luminous trail upon being discharged from a paintball gun.

* * * * *